US006499761B1

(12) United States Patent
Quellais

(10) Patent No.: US 6,499,761 B1
(45) Date of Patent: Dec. 31, 2002

(54) DEVICE FOR FIXING A SHOE TO A SPORTS ARTICLE

(75) Inventor: Jacques Quellais, Saint-Jorioz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/763,614

(22) PCT Filed: Aug. 24, 1999

(86) PCT No.: PCT/FR99/02029

§ 371 (c)(1),
(2), (4) Date: Apr. 3, 2001

(87) PCT Pub. No.: WO00/13755

PCT Pub. Date: Mar. 16, 2000

(30) Foreign Application Priority Data

Sep. 2, 1998 (FR) ..... 98 11171

(51) Int. Cl.[7] ..... A63C 9/00

(52) U.S. Cl. ..... 280/623; 280/11.3; 280/611; 280/634

(58) Field of Search ..... 280/11.3, 11.31, 280/613, 614, 615, 617, 618, 607, 623, 626, 634

(56) References Cited

U.S. PATENT DOCUMENTS

| | | | | | |
|---|---|---|---|---|---|
| 2,586,339 | A | * | 2/1952 | Hvam | 280/619 |
| 2,686,059 | A | * | 8/1954 | Whitaker | 280/614 |
| 2,758,846 | A | * | 8/1956 | Swensen | 280/614 |
| 2,764,418 | A | * | 9/1956 | Shimizu | 280/614 |
| 3,865,389 | A | * | 2/1975 | Delery | 280/637 |
| 3,944,237 | A | * | 3/1976 | Teague, Jr. | 280/618 |
| 4,027,896 | A | * | 6/1977 | Frechin et al. | 280/613 |
| 4,273,355 | A | * | 6/1981 | Storandt | 280/614 |
| 4,718,694 | A | * | 1/1988 | Brice et al. | 280/605 |
| 4,909,531 | A | * | 3/1990 | Graillat | 280/615 |
| 5,669,622 | A | * | 9/1997 | Miller | 280/615 |
| 5,829,776 | A | * | 11/1998 | Deville et al. | 280/602 |
| 5,890,724 | A | | 4/1999 | Gignoux et al. | 280/11.28 |
| 6,082,744 | A | * | 7/2000 | Allinger et al. | 280/11.12 |
| 6,113,111 | A | | 9/2000 | Gierveld et al. | 280/11.15 |
| 6,152,458 | A | * | 11/2000 | Edauw et al. | 280/11.14 |

FOREIGN PATENT DOCUMENTS

| | | | | | |
|---|---|---|---|---|---|
| DE | 29711692 | | | 10/1997 | |
| EP | 0786275 | | | 7/1997 | |
| EP | 0890379 | | | 1/1999 | |
| FR | 2659534 | | | 9/1991 | |
| FR | 0768103 | A1 | * | 9/1996 | A63C/9/20 |
| IT | WO87/01296 | | * | 3/1987 | 280/614 |
| IT | 0914844 | A1 | * | 12/1999 | A63C/1/28 |
| NL | 8702068 | | | 4/1989 | |
| NL | WO 96/37269 | | * | 11/1996 | A63C/1/28 |
| WO | WO96/37269 | | | 11/1996 | |
| WO | WO97/21474 | | | 6/1997 | |
| WO | WO98/02216 | | | 1/1998 | |

* cited by examiner

*Primary Examiner*—Brian L. Johnson
*Assistant Examiner*—Kelly E Campbell
(74) *Attorney, Agent, or Firm*—Greenblum & Bernstein, P.L.C.

(57) ABSTRACT

A device for binding a boot to a sports article. The device includes a base adapted to be fixed onto the sports article, a member for connecting to the boot, the member including an anchoring element on a front zone of the boot, a rocker bar for connecting the connecting member to the base, the rocker bar being journalled on the base, on the one hand, and on the connecting member, on the other hand, the journal axle of the rocker bar on the base being arranged at the rear of the journal axle of the connecting member on the rocker bar.

26 Claims, 2 Drawing Sheets

DEVICE FOR FIXING A SHOE TO A SPORTS ARTICLE

BACKGROUND OF THE INVENTION

1. Field of the Invention

The present invention relates to a device for a journal binding of a boot to a sports article, in particular a gliding sport, such as ice skating, roller skating, cross-country skiing, etc.

2. Description of Background and Relevant Information

It is already known from FR 2 659 534 to have a journalled linkage of a boot to a sports article such as a roller skate, ice skate, so as to increase the impulse torque during the sporting activity. The document provides either a journal of the boot on the sports article in the location of the big toe in the boot so as to enable a maximum rotation of the boot, or a journal in the metatarsophalangeal articulation zone of the foot so as to guarantee a good foot movement.

In the first case, the maximum rotation of the boot makes it possible to maximize the impulse torque of the leg during the motive phase, but this occurs to the detriment of precision and guiding of the boot, in particular with a flexible sole that is necessary for a good foot movement.

In the second case, the journal in the metatarsophalangeal journal axis makes it possible to improve the guiding to the detriment, however, of the foot movement and the impulse torque.

The document WO 96/37269 aims to resolve the same problem, namely, maximizing the thrust force or impulse torque during the sporting activity by proposing a multiple frame construction in which the frames are adapted to pivot and to translate one with respect to the other.

The preferred embodiments of this document WO 96/37269 include at least four connecting rods that are journalled and which can translate with respect to one another. As a result, it is an extremely complicated, heavy, expensive, difficult to implement and fragile construction, especially if the sport must be practiced in an aggressive environment (cold, snow, dust, etc.).

The document WO 96/37269 also proposes another construction which uses meshings and, therefore, is also extremely complicated and expensive to make, and is also very sensitive to dirt, cold, snow, etc.

Furthermore, each of the constructions of the document WO 96/37269 can only allow movements of the boot that are limited and comprised between 20° and 48°, these small movements being detrimental to a good practice of the sporting activity.

SUMMARY OF THE INVENTION

An object of the present invention is to overcome the aforementioned disadvantages and to provide an improved binding device that makes it possible, in particular, to maximize the impulse torque transmitted by the leg, while being compatible with proper guiding of the boot, large displacement and good precision of the movement.

Another object is also to provide a binding device whose construction is simple, inexpensive, compact, and which is insensitive to external conditions, in particular cold and snow.

This object is achieved in the device for binding a boot to a sports article according to the invention, due to the fact that it comprises a base adapted to be fixed to the sports article, a member for connecting to the boot comprising an anchoring means or element on a front zone of the boot, a rocker bar for connecting the connecting member to the base, the rocker bar being journalled on the base, on the one hand, and on the connecting member, on the other hand, the journal axis of the rocker bar on the base being arranged at the rear of the journal axis of the connecting member on the rocker bar.

Indeed, the connecting member, fixed on a front zone of the boot, stiffens the latter and therefore makes it possible to maintain the desired precision of movement, whereas a construction having a single rocker bar is simple, minimum, compact, and inexpensive.

Furthermore, such a construction is insensitive to cold and snow.

BRIEF DESCRIPTION OF THE DRAWING

The invention will be better understood and other characteristics thereof will become apparent from the description that follows, with reference to the annexed schematic drawings showing, by way of non-limiting examples, a plurality of preferred embodiments, and in which.

DETAILED DESCRIPTION OF THE INVENTION

Figure 1:
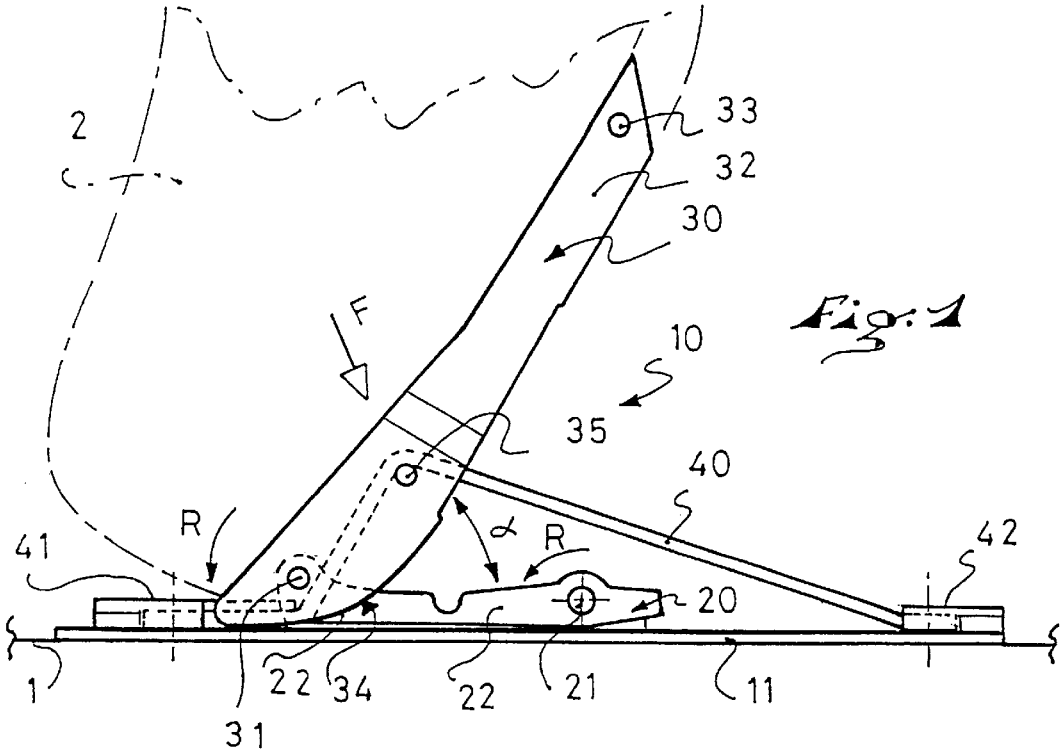
FIG. 1 is a side view of the binding device according to the invention in raised position, the boot being shown in dot-and-dashed lines.

FIG. 1 shows the binding device 10 according to the invention ensuring the linkage of a boot 2 to a sports article 1.

The binding device includes a base 11 fixed on the upper surface of the sports article 1, a rocker bar 20 journalled on the base 11 about a transverse axle 21, a connecting member 30 journalled along a transverse axle 31 on the rocker bar 20, and an elastic return means 40 constituted in this case by a band of elastic material such as rubber or Pebax. The connecting member 30 can be regarded as a first connecting member, to be connected to the boot, whereby the rocker bar 20 can be regarded as a second connecting member for connecting the first connecting member 30 to the base 11.

Figure 2:
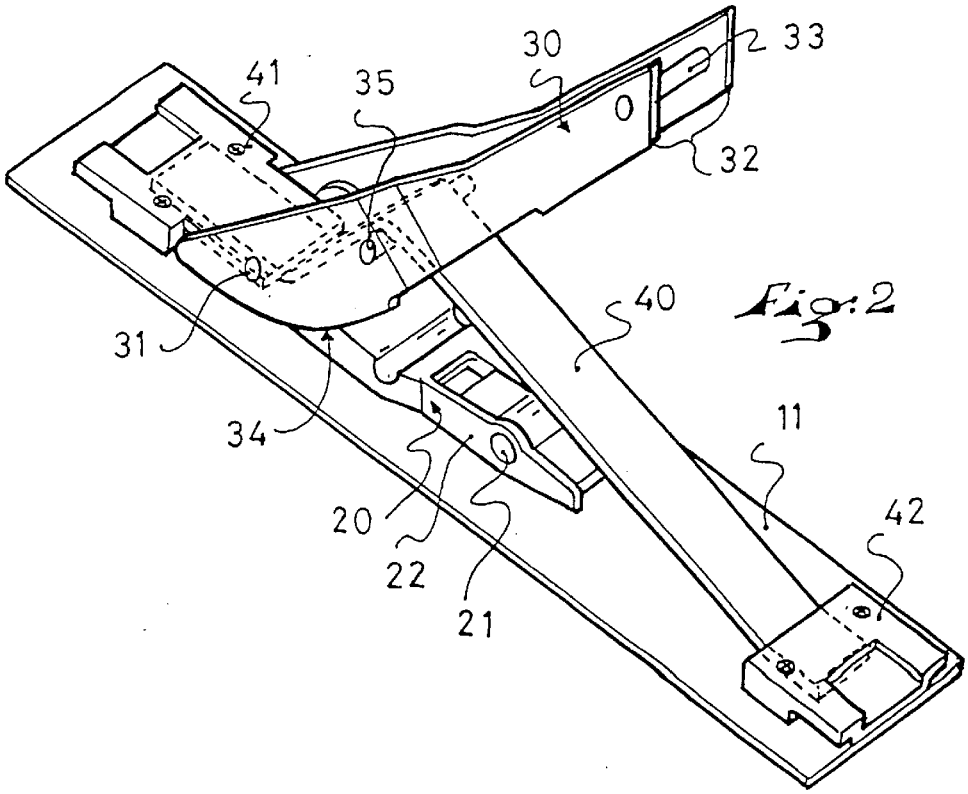
FIG. 2 is a rear perspective view of the binding device of FIG. 1.

As shown more particularly in FIG. 2, the connecting member 30 is in the form of a beam constituted of two rocker bars 32 spaced apart at the front by the transverse journal axle 31 on the rocker bar 20, on the one hand, and by an axle 33 arranged at the rear of the two rocker bars, on the other hand. These axles 31, 33 also serve as an anchoring means or element for the boot and are adapted to cooperate with complementary means of the sole or of the boot upper (which are not shown in the drawing). Of course, other anchoring means can be envisioned, and, in particular, the beam 30 can be integrated in the boot sole, for example by being molded to the sole during manufacture of the boot, or can be fixed to the latter by screws, rivets, etc.

Removable anchoring means, i.e., which enable a quick removal of the boot can also be provided.

The connecting member 30 can also be obtained in a different manner, and in particular can be constituted by a beam in a single piece, in a buckled plate, or in another synthetic material, etc.

The beam defined by the connecting member 30 preferably has a length corresponding to that of the front zone, which extends from the front end up to the metatarsophalangeal journal zone of a boot, i.e., approximately a third of the length of a boot.

The object of this beam 30 is not only to obtain the linkage of the boot to the sports article, but also to stiffen the boot so as to enable a better guiding and transmission of the forces when the boot is raised during the sporting activity.

Of course, the beam 30 can also have any other shape, and in particular it can be longer or shorter.

The front portion of each of the rocker bars 32 has a curved profile 34 in the form of a ramp by which each of these rocker bars 32 is in support on the base 11. This curved profile 34 cooperates with the base 11 during pivoting of the boot so as to reproduce a rotational and translational movement corresponding to the movement of the foot in the area of the big toe. As can be seen in the figures, the curved support ramp 34 is in rolling engagement with the base 11 as the rear of the boot and a rear of the connecting member moves up and down during use.

This construction makes it possible to reproduce a movement of the foot, as if the journal axis of the boot were fixed at the front end of the latter, while maintaining the precision of the rigid sole, since the sole is in fact stiffened by the beam 30, up to the tip of the toes, i.e., by offering a maximum impulse torque.

Therefore, the construction according to the invention makes it possible to reconcile maximum guiding and precision of the movement with an equally maximum transmission of power.

Figure 4:
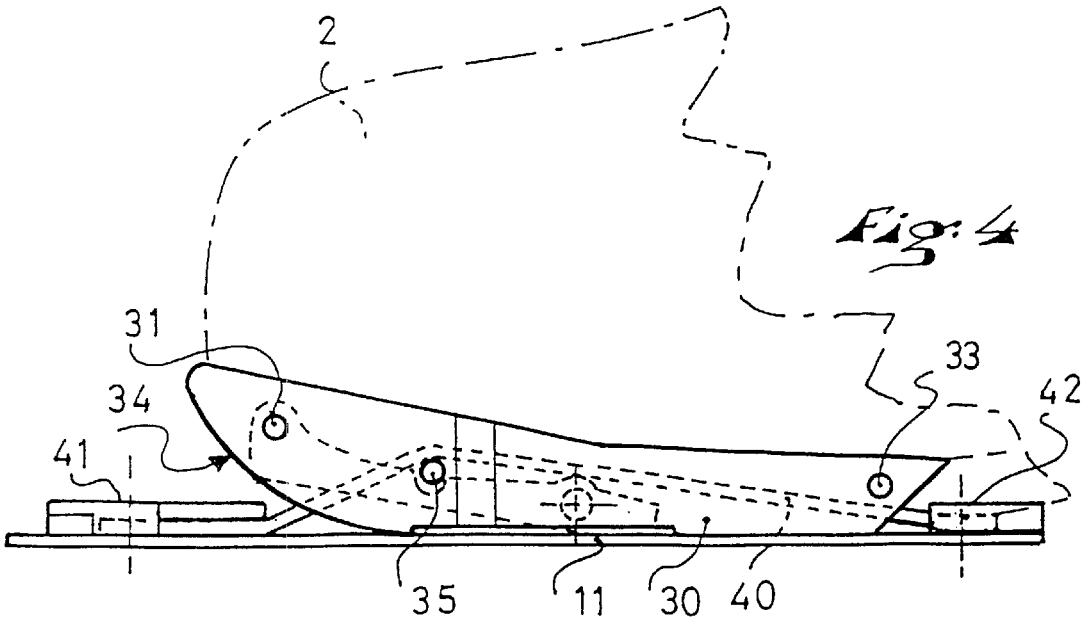
FIG. 4 is a view similar to FIG. 1 in the lowered position.

As seen in FIG. 4, in a lowered position of the first connecting member 30, the curved support ramp 34 has a forward surface spaced above the base 11 and a surface rearward of the forward surface in engagement with the base. Further, as seen in FIG. 1, in a raised position of the first connecting member 30, the curved support ramp 34 has the forward surface in engagement with the base 11 and the surface rearward of this forward surface is spaced above the base 11.

A rubber band 40 is fixed at 41 and 42 on the base 11, for example, by screws, at the front and rear of the beam 30, and on both sides of its support zone on the sports article. Furthermore, this band 40 passes above an axle 35, or spacer, arranged transversely between the two rocker bars 32, at the rear of the ramp 34.

Thus arranged, the rubber band 40 exerts, in the area of the axle 35 on the beam 30, and therefore on the boot 2 which is connected thereto, a constant force F of elastic return toward the upper surface 1 of the sports article. This construction helps in bringing the sports article back against the boot sole at the end of the impulse phase and avoids any interference thereof with the surface on which the sport is practiced.

In this context, it is preferred that the point 35 of application of the force F be located at the rear of the ramp 34, but in front of the journal axle 21 of the rocker bar 20, to avoid an equilibrium position of the boot raised with respect to the sports article 1 in the absence of forces exerted by the user.

As the case may be and depending on the type of sport involved, a position further in front of this point of application 35 of the force F can also be envisioned. The elastic band 40 can be replaced by any other elastic return means, and in particular a spring, which produces the same effect.

The rocker bar 20 is in the form of an integral piece whose ends are constituted of two arms 22 spaced apart by the pivoting axle 31 of the beam 30, on the one hand, and by the journal axle 21 of the rocker bar on the base 11, on the other hand, each of these axles 21, 31, being arranged at each of the ends of the rocker bar 20, the axle 21 being arranged at the rear of the axle 31. Of course, the rocker bar 20 can also be constituted of a plurality of portions.

The length of the rocker bar 20, i.e., the distance between the journal axles 21, 31, thereof, determines the pivoting angle of the ramp 34.

Figure 3:
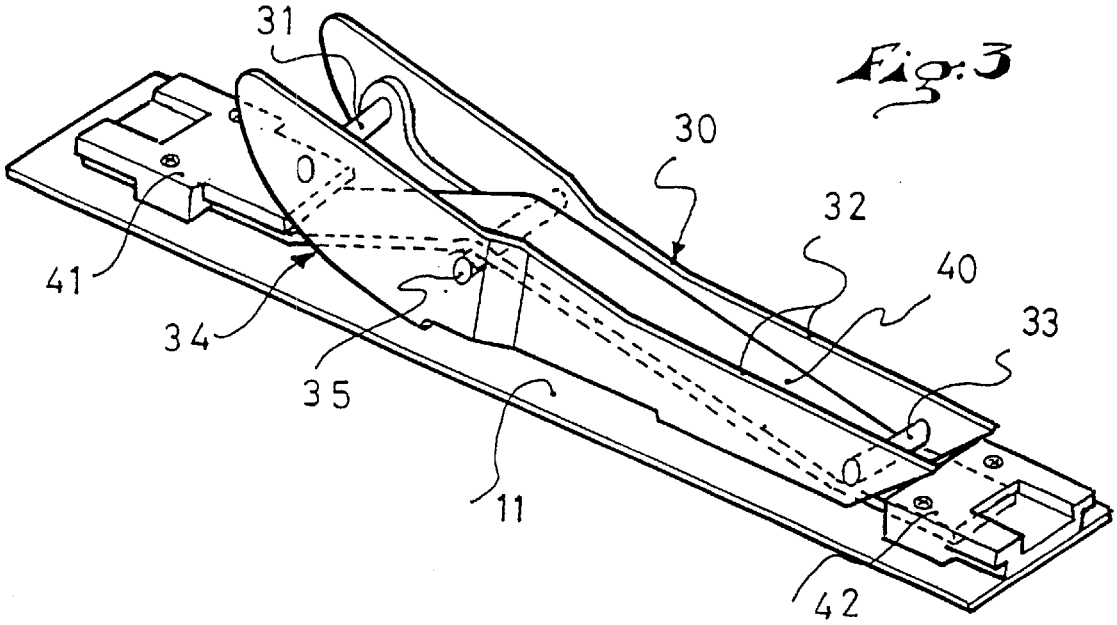
FIG. 3 is a view similar to FIG. 2 in a lowered position.

The functioning of this binding device is very simple. In the absence of any force from the user, the beam 30 is applied against the base 11 under the effect of the elastic return means 40 (see FIGS. 3 and 4).

During movement of the foot, the beam 30 and the rocker bar 20 simultaneously perform a clockwise rotation (arrows R) about their respective axles 31, 21, the beam 30 furthermore pivoting on the base 11 along a series of supports constituting as many instantaneous rotation axes and moving along the curved ramp 34.

The pivoting of the beam 30 on the base 1. along the curved ramp 34 makes it possible to reproduce a rotational and translational movement corresponding to the natural movement of the foot in the area of the big toe thereof, and therefore makes it possible to reconcile the benefit of a maximum impulse torque and the preservation of natural sensations of touch with the guiding and precision characteristics of a rigid sole.

As shown in FIGS. 1 and 2, this construction also enables a maximum rotation, with an angle a on the order of 60° and more, between the beam 30 and the base 11, which therefore reproduces a complete movement of the foot up to the tip of the big toe. In fact, this angle of rotation $\alpha$ can even be greater than 60° depending on the desired practice. The value of this angle $\alpha$ will depend on the elastic means 40 and on the shape of the curved ramp 34.

Such an angle of rotation is substantially greater than the angles of movement allowed by the known constructions, is particularly advantageous in the majority of sports involved, and in particular cross-country skiing, whether it is in the so-called conventional technique, or in the so-called skating or skating step technique.

Of course, the present invention is not limited to the embodiment described hereinabove by way of non-limiting example, but encompasses all similar or equivalent embodiments.

It also applies to any sport in which similar or equivalent problems must be resolved.

What is claimed is:

1. A device for binding a boot to a sports article, said device comprising:

a base to be fixed on the sports article;

a connecting member for connecting to the boot, the connecting member comprising:

an anchoring element for connection to a front zone of the boot; and a curved support ramp at a front portion of the connecting member, the curved support ramp being in rolling engagement with the base during movement of a rear of the connecting member up and down relative to the base; and a rocker bar connecting the connecting member to the base, the rocker bar being journalled on the base and on the connecting member, the journal of the rocker bar on the base being arranged rearward of the journal of the connecting member on the rocker bar.

2. A binding device according to claim 1, wherein the curved support ramp has a shape corresponding substantially to the outer contour of the big toe of a user.

3. A binding device according to claim 1, further comprising means for elastically returning the connecting member toward the base.

4. A binding device according to claim 3, wherein the means for elastically returning the connecting member toward the base is arranged to apply a force at a rear of the curved support ramp.

5. A binding device according to claim 3, wherein the means for elastically returning the connecting member toward the base is arranged to apply a force at a front of the journal of the rocker bar on the base.

6. A binding device according to claim 3, wherein said means for elastically returning the connecting member toward the base are constituted by a rubber blade anchored on the base on both sides of a support zone of the connecting member.

7. A binding device according to claim 1, wherein the connecting member extends substantially from the front end of the boot up to a metatarsophalangeal journal zone of the boot.

8. A binding device according to claim 1, wherein the connecting member has a maximum pivoting angle relative to the base substantially equal to 60°.

9. A binding device according to claim 1, wherein the connecting member has a maximum pivoting angle relative to the base of greater than 60°.

10. A binding device according to claim 1, wherein the curved support ramp comprises means for simulating a curvature substantially corresponding to a contour of a lower surface of a big toe of a user.

11. A device for binding a boot to a sports article, said device comprising a base to be fixed on the sports article, a member for connecting to the boot, a rocker bar connecting the connecting member to the base, a first journal journalling the rocker bar to the base and a second journal journalling the rocker bar to the connecting member, wherein the connecting member has a curved support ramp with a surface in engagement with the base during pivoting of the connecting member.

12. A binding device according to claim 11, wherein the first journal is rearward of the second journal.

13. A binding device according to claim 12, wherein the rocker bar is rotatable about an axis of the first journal and the connecting member is rotatable about an axis of the second journal, wherein rotation of said rocker bar and said connecting member about said first and second journals, respectively, is in the same direction.

14. A binding device according to claim 11, further comprising a spring applying an elastic force biasing the connecting member toward the base.

15. A binding device according to claim 11, wherein the rocker bar is the only non-elastic element linking the base and the connecting member.

16. A device for binding a front zone of a boot to a sports article while allowing reciprocatory movement of a rear zone of the boot relative to the sports article, said device comprising:

a base adapted to be fixed onto the sports article;

a first connecting member comprising at least one anchoring element for connection to the front zone of the boot, said connecting member being fixed against movement relative to the boot, said first connecting member being movable relative to said base, during the reciprocatory movement of the rear zone of the boot, between a lowered position and a raised position;

said first connecting member further comprising a curved support ramp at a lower and front portion of said first connecting member;

a second connecting member for connecting said first connecting member to said base, said second connecting member being journalled to said first connecting member along a first axis and being journalled to said base along a second axis, said second axis being rearward of said first axis;

in a lowered position of said first connecting member, said curved support ramp having a forward surface spaced above said base and a surface rearward of said forward surface in engagement with said base; and in a raised position of said first connecting member, said curved support ramp having said forward surface in engagement with said base and said surface rearward of said forward surface spaced above said base.

17. A binding device according to claim 16, wherein said second connecting member is a rocker bar, said rocker bar being journalled to said first connecting member about an axis extending along said anchoring element of said first connecting member.

18. A binding device according to claim 17, wherein, during movement from said raised position to said lowered position of said first connecting member, said rocker bar rotates about second axis in a predetermined direction and said first connecting member rotates in said predetermined direction about said axis extending along said anchoring element of said first connecting member.

19. A binding device according to claim 16, wherein said curved support ramp of said first connecting member comprises a continuous downwardly facing convex surface.

20. A binding device according to claim 16, further comprising means for elastically urging said first connecting member toward said base.

21. A binding device according to claim 20, wherein said means for elastically urging said first connecting member toward said base is arranged to apply a force directed toward a rear of said curved support ramp.

22. A binding device according to claim 20, wherein said means for elastically urging said first connecting member toward said base is arranged to apply a force directed forward of said second axis.

23. A binding device according to claim 20, wherein said means for elastically urging said first connecting member toward said base are constituted by a rubber blade anchored on said base on opposite longitudinal ends of a support zone of said first connecting member.

24. A binding device according to claim 16 in combination with the boot, wherein said first connecting member extends substantially from a front end of said boot to a metatarsophalangeal journal zone of said boot.

25. A binding device according to claim 16, wherein, between said raised and lowered positions, said first connecting member pivots about an angle substantially equal to 60°.

26. A binding device according to claim 16, wherein, between said raised and lowered positions, said first connecting member pivots about an angle greater than 60°.

* * * * *